US007351045B2

(12) United States Patent
Sugimoto et al.

(10) Patent No.: US 7,351,045 B2
(45) Date of Patent: Apr. 1, 2008

(54) ROTATIONAL INHIBITOR FOR COMPRESSOR LUBRICANT

(75) Inventors: Kazuyoshi Sugimoto, Gunma-ken (JP); Yasunori Kiyokawa, Gunma-ken (JP); Yoshiaki Koike, Gunma-ken (JP); Kenji Aida, Gunma-ken (JP)

(73) Assignee: Sanyo Electric Co., Ltd., Osaka-fu (JP)

( * ) Notice: Subject to any disclaimer, the term of this patent is extended or adjusted under 35 U.S.C. 154(b) by 0 days.

(21) Appl. No.: 11/523,673

(22) Filed: Sep. 19, 2006

(65) Prior Publication Data

US 2007/0065307 A1 Mar. 22, 2007

(30) Foreign Application Priority Data

Sep. 20, 2005 (JP) ..... 2005-272539

(51) Int. Cl.
*F04C 15/00* (2006.01)
*F04C 2/00* (2006.01)

(52) U.S. Cl. ..... 418/88; 418/94; 418/55.6; 184/6.16; 184/6.18

(58) Field of Classification Search ..... 418/55.1–55.6, 418/88, 94; 184/6.16–6.18; 417/410.5
See application file for complete search history.

(56) References Cited

U.S. PATENT DOCUMENTS 5,277,564 A * 1/1994 Tamura et al. ..... 418/55.6

FOREIGN PATENT DOCUMENTS

| | | | |
|---|---|---|---|
| JP | A 5-65884 | 3/1993 | |
| JP | 05302580 A * | 11/1993 | ..... 418/88 |
| JP | A 6-26469 | 2/1994 | |
| JP | A 9-32760 | 2/1997 | |
| JP | 10220377 A * | 8/1998 | |

* cited by examiner

*Primary Examiner*—Theresa Trieu
(74) *Attorney, Agent, or Firm*—Weingarten, Schurgin, Gagnebin & Lebovici LLP

(57) ABSTRACT

A compressor comprises an oil storage provided in the bottom of a container body. An oil cup is fixed in communication with the oil storage. An oil pump is attached to the lower end of a shaft and inserted into the oil cup. A rotation inhibitor is provided including a plurality of plates each having one end fixed to the inner wall of the oil cup and the other end disposed almost vertically toward the central axis of the oil cup. The plate has an upper end located in the vicinity of the upper edge of the oil cup, a lower end located in the vicinity of the bottom of the oil cup, and side ends located in the vicinity of the outer wall of the oil pump.

5 Claims, 2 Drawing Sheets

ROTATIONAL INHIBITOR FOR COMPRESSOR LUBRICANT

This application claims priority to Japanese application No. 2005-272539 filed Sep. 20, 2005.

BACKGROUND OF THE INVENTION

1. Field of the Invention

The present invention relates to a compressor, and more particularly to a compressor equipped with a rotation inhibitor capable of inhibiting oil in an oil cup to rotate due to rotational friction in a lubricant supply mechanism.

2. Description of the Related Art

In general, known compressors for use in compression of gases may be of the reciprocation type, the rotary type and the scroll type. These compressors comprise an electric element including an electric motor, and a compressive element driven by the electric element. They are operative to compress a gas such as a refrigerant gas led into the compressive element and discharge the compressed gas, which is fed to an air conditioner, a refrigerator, or a freezer/refrigerator in a freezing cycle.

The compressors of such the types generally include an oil storage to store lubricant oil provided in the bottom of a container that configures a compressor body. An oil pump is attached to an end of a driveshaft axially installed on the rotor of the electric element. This oil pump is operative to suck up the oil from the oil storage and supply the oil to a sliding portion of the compressive element and a bearing portion of the driveshaft for lubrication through an oil passage provided in the driveshaft along the axial line. The oil once used in lubrication is fed back to the oil storage and reused repeatedly in this structure.

As the oil pump is attached to the end of the driveshaft, rotations of the driveshaft cause rotations of the oil pump. A centrifugal force associated with the rotation sucks up the oil from the oil storage and elevates the oil along the inner wall of the oil passage provided in the driveshaft. As a result, the oil is supplied to the sliding portion of the compressive element and the bearing portion of the driveshaft. When the amount of oil in the oil storage reduces and rotational friction associated with the rotation of the oil pump rotates the oil, the oil surface in the oil storage may recede almost parabolic in cross-section, or may wave. When it falls into such the state, the oil surface in vicinity of a suction port of the oil storage lowers or becomes unstable. This reduces the amount of the oil sucked or makes it impossible to suck up the oil, resulting in a reduction in lubricating function as a problem because of the reduction in the amount of the oil supplied to the sliding portion and the bearing portion.

As a means for solving such the problem, Patent Document 1 (JP-A 6-26469) discloses a scroll compressor equipped with an oil plate to inhibit disturbance of the oil surface in the oil storage. In this case, when the upper surface of the oil plate is located slightly lower than the oil surface, the effect of inhibiting the disturbance of the oil surface can be achieved. In contrast, when the oil surface lowers below the lower surface of the oil plate, it waves because the effect of inhibiting the disturbance of the oil surface can not be achieved sufficiently. When the oil surface lowers further, it recedes almost parabolic in cross-section in response to the rotation of the oil pump and makes it difficult or impossible to suck up the oil from the oil pump.

Patent Document 2 (JP-A9-32760) discloses a scroll compressor equipped with an agitation inhibitor as surrounding the oil pump. The agitation inhibitor restraints the range of rotational friction associated with the oil pump acting in the oil storage. Also in this case, when the oil surface lowers and locates near the lower surface of the oil pump, it recedes almost parabolic in cross-section in response to the rotation of the oil pump and makes it difficult or impossible to suck up the oil from the oil pump. Patent Document 3 (JP-A 5-65884) discloses a scroll compressor equipped with an agitation inhibitor having a cylindrical portion formed as covering the lower portion of the rotor and surrounding the oil pump. Also in this case, when the oil surface lowers near the lower surface of the oil pump, it recedes almost parabolic in cross-section in response to the rotation of the oil pump and makes it difficult or impossible to suck the oil from the oil pump.

SUMMARY OF THE INVENTION

The present invention has been made in consideration of the above prior art and has an object to provide a compressor. This compressor is configured to prevent the oil surface from receding almost parabolic in cross-section in response to the rotation of the oil pump even if the oil surface in the oil storage lowers, thereby providing that the oil pump can surely suck up the oil.

To achieve the above object, in a first aspect the present invention provides a compressor, comprising: a container; an electric element provided in the container; a compressive element driven by the electric element; an oil storage provided in the bottom of the container; an oil cup fixed in communication with the oil storage; a driveshaft axially installed on the rotor of the electric element; an oil pump attached to the lower end of the driveshaft, the oil pump having a suction port located on the central axis of the oil cup and in the vicinity of the bottom of the oil cup; and a rotation inhibitor provided on an inner wall of the oil cup to inhibit oil in the oil cup to rotate due to friction to lower the surface of the oil at the suction port of the oil pump.

In a second aspect of the present invention, the rotation inhibitor includes a plate having one end fixed to the inner wall of the oil cup and the other end disposed almost vertically toward the central axis of the oil cup.

In a third aspect of the present invention, the plate is rectangular and attached as locating an upper end in the vicinity of the upper edge of the oil cup, a lower end in the vicinity of the bottom of the oil cup, and side ends in the vicinity of the outer wall of the oil pump.

In a fourth aspect of the present invention, the plate is one of a plurality of such plates attached at an equal interval along the inner wall of the oil cup.

In the first aspect of the invention, an oil storage is provided in the bottom of the container and an oil cup is fixed in communication with the oil storage. An oil pump is inserted and arranged along the central axis of the oil cup. The oil pump has a suction port located in the vicinity of the bottom of the oil cup. This compressor comprises a rotation inhibitor provided on an inner wall of the oil cup to inhibit oil in the oil cup to rotate due to rotational friction. This makes it possible to prevent the oil surface from receding almost parabolic in cross-section in response to the rotation of the oil pump even if the oil surface in the oil storage lowers. As a result, the oil can be surely sucked up from the suction port of the oil pump and sufficiently supplied to the sliding portion of the compressive element and the bearing portion of the driveshaft for lubrication.

In the second aspect of the invention, the rotation inhibitor is formed of a plate. This plate has one end fixed to the inner wall of the oil cup and the other end disposed almost vertically toward the central axis. Therefore, the plate exerts the action as an obstructer plate on the rotation of oil in the oil cup to inhibit the rotation of oil associated with the rotation of the oil pump.

In the third aspect of the invention, the plate is rectangular and attached as locating an upper end in the vicinity of the upper edge of the oil cup, a lower end in the vicinity of the bottom of the oil cup, and side ends in the vicinity of the outer wall of the oil pump. Therefore, it is possible to surely inhibit the rotation of oil in the oil pump.

In the fourth aspect of the invention, the plate is one of a plurality of such plates attached at an equal interval along the inner wall of the oil cup. Therefore, it is possible to further surely inhibit the rotation of oil in the oil pump.

DETAILED DESCRIPTION OF THE INVENTION

Figure 1:
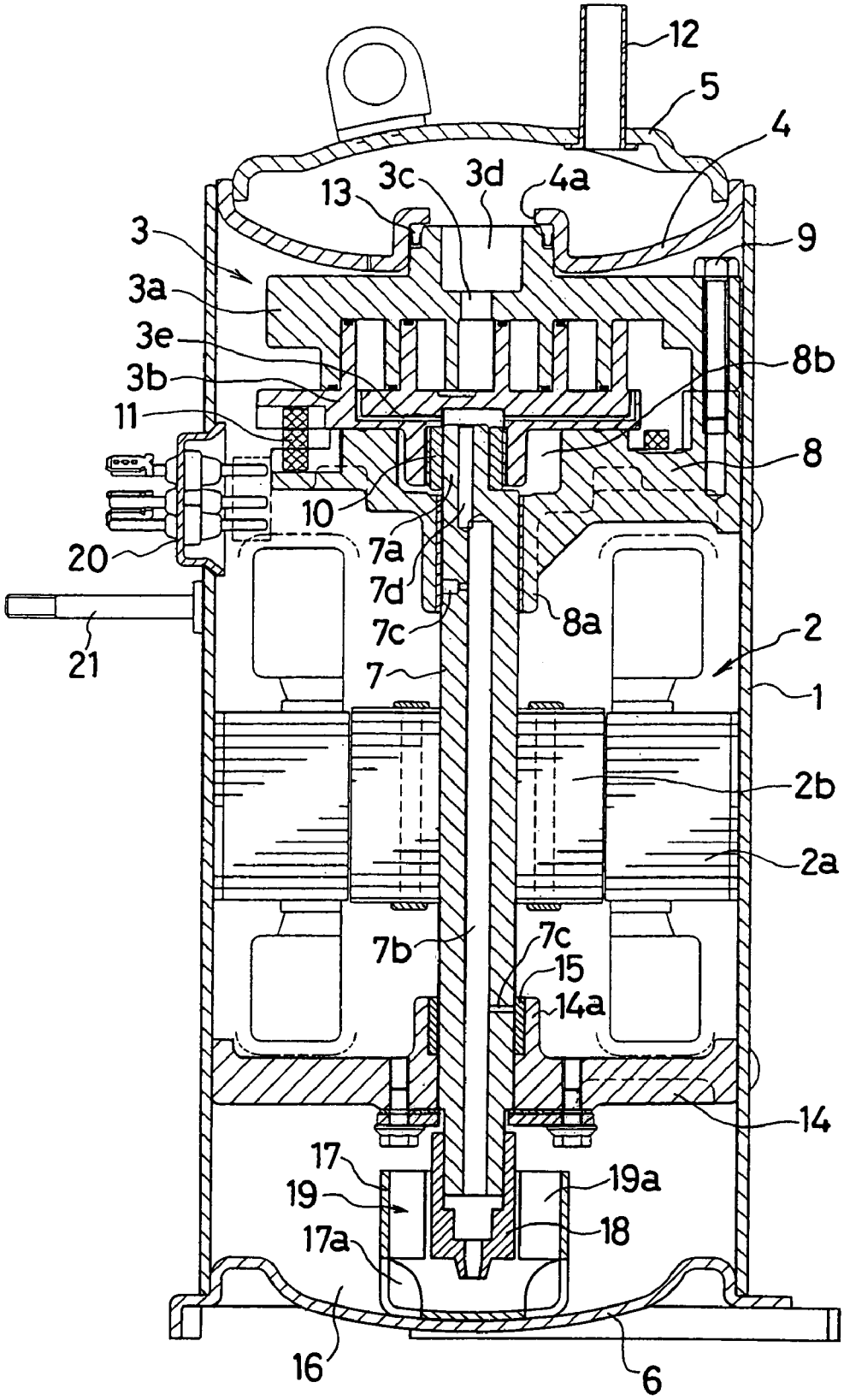
FIG. 1 is a brief vertical cross-sectional view showing an embodiment of the present invention applied to a scroll compressor.

An embodiment associated with the compressor according to the present invention will be described with reference to the accompanying drawings. FIG. 1 is a brief vertical cross-sectional view showing an embodiment of the present invention applied to a scroll compressor. In the figure, the reference numeral 1 denotes a cylindrical container body, which houses an electric element 2 and a compressive element 3 driven by the electric element 2 as arranged in the body. An upper cap 5 is attached to the upper end of the container body 1 with a partition disc 4 interposed therebetween. A lower cap 6 is attached to the lower end of the container body 1 to configure a hermetic container.

The electric element 2 is an electric motor, which includes a stator 2*a* having an outer circumferential portion fixed on the inner wall of the container body 1 almost at the central portion, and a rotor 2*b* rotatably disposed on the central portion of the stator 2*a*. A driveshaft 7 is inserted through and axially installed on the central portion of the rotor 2*b*.

The compressive element 3 is of the publicly known scroll type, which includes a fixed scroll 3*a* having a swirling recess on the almost disc-like lower surface, and a swinging scroll 3*b* having a swirling protrusion on the almost disc-like upper surface. The swirling recess and protrusion of these paired scrolls are combined to form a compression chamber for use in compressive actions. In a word, the fixed scroll 3*a* is kept stationary while the swinging scroll 3*b* is controlled not to rotate but to turn about the central axis thereof. As a result, the compression chamber formed of the above recess and protrusion rotates in response to turns of the swinging scroll 3*b* and shifts to the central portion to gradually reduce the volume thereof. In this case, a gas sucked from external into the compressive element 3 is pressurized in accordance with the equal entropy variation by the volumetric variation in the compression chamber.

An upper support frame 8 is fixed on the upper inner wall of the container body 1. On the upper outer circumferential portion of the upper support frame 8, the fixed scroll 3*a* is secured via a mounting bolt 9 (only one piece is depicted though plural pieces are employed in practice). Through a bearing portion 8*a* formed at the central portion, the upper end of the driveshaft 7 is axially passed and supported. A circular recess 8*b* is formed at the central portion in the upper surface of the upper support frame 8. The driveshaft 7 passed through the bearing portion 8*a* has an eccentric cum 7*a*, which is protruded into the recess 8*b*. The swinging scroll 3*b* has a protruded cylindrical portion in the lower surface, which is fitted into the eccentric cum 7*a* via a bearing 10. Thus, the swinging scroll 3*b* is combined with the fixed scroll 3*a*. The upper support frame 8 and the swinging scroll 3*b* are jointed through an oldham ring 11 to restrict rotations of the swinging scroll. As a result, the eccentric cum 7*a* rotates eccentrically in response to rotations of the driveshaft 7 about the axis, and the eccentric cum 7*a* causes the swinging scroll 3*b* not to rotate but to turn relative to the fixed scroll 3*a*.

The partition disc 4 has a hole 4*a* provided through the central portion. The through hole 4*a* is brought into communication with a discharge port 3*c* provided at the central portion of the fixed scroll 3*a*, and a recess 3*d* located adjacent to the discharge port 3*c*. As a result, the gas compressed at the compressive element 3 is discharged from the discharge port 3*a* of the fixed scroll 3*a*. After flowing through the recess 3*d* and the through hole 4*a* into the upper spatial region partitioned with the partition disc 4, the gas is discharged to external through a discharge pipe 12 attached to the upper cap 5. A seal material 13 is installed on an attachment portion between the central portion of the partition disc 4 and the cylindrical portion formed in the upper surface of the fixed scroll 3*a*. This seal prevents the compressed high-pressure gas led to the upper spatial region (high-pressure region) from leaking to the lower spatial region (low-pressure region) located below the partition disc 4. A pressure open/close valve (not shown) is attached to the recess 3*d* to open/close the discharge port 3*c*.

A lower support frame 14 is fixed on the lower inner wall of the container body 1. The lower support frame 14 has a bearing portion 14*a* formed in the central portion, on which a bearing 15 is installed, and the lower end of the driveshaft 7 is passed through and axially supported. As a result, the upper and lower ends of the driveshaft 7 are axially supported by the bearing portion 8*a* of the upper support frame 8 and the bearing portion 14*a* of the lower support frame 14, respectively. Accordingly, the rotation about the axis in response to the rotation of the rotor 2*b* can be stabilized and an appropriate position of the rotor 2*b* can be retained relative to the stator 2*a*.

An oil storage 16 that stores lubricant oil is provided in the bottom of the container body 1. An oil cup 17 is fixed on the central portion in the upper surface of the lower cap 6. The oil cup 17 has a plurality of through holes 17*a* formed at an equal interval along the circumference beneath the sidewall. Through these holes 17*a*, the inside of the oil cup 17 is brought into communication with the oil storage 16. A rotation inhibitor 19 is provided on the inner wall of the oil cup 17 to inhibit oil in the oil cup 17 to rotate due to rotational friction.

Figure 3:
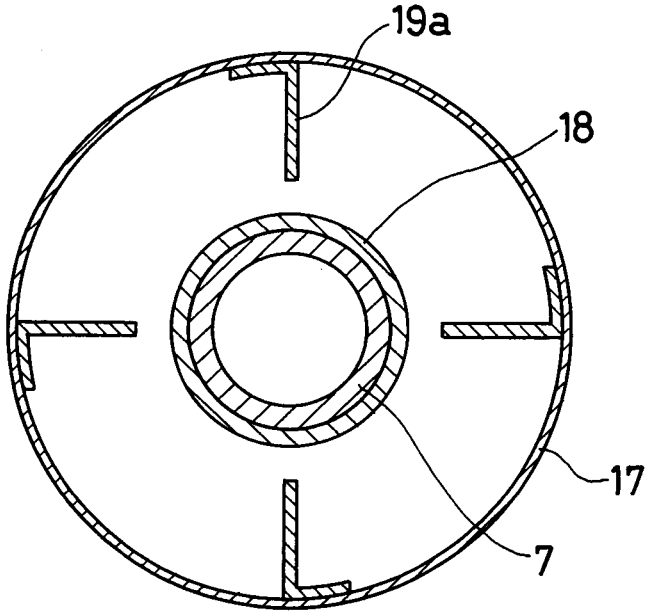
FIG. 3 is a brief horizontal cross-sectional view taken along X-X line in FIG. 2.

In this embodiment, the rotation inhibitor 19 includes a plate 19*a* having one end fixed to the inner wall of the oil cup 17 and the other end disposed almost vertically toward the central axis of the oil cup 17. The plate 19*a* is rectangular and having an upper end on or near the upper edge of the oil cup 17, a lower end on or near the bottom of the oil cup, and side ends in the vicinity of the outer wall of the oil pump 18. Four such plates 19*a* are attached at an equal interval along the inner wall of the oil cup 17 as shown in FIG. 3. The shape of the plate 19*a* is not limited to rectangle and the number of the pieces is not limited to four. The rotation inhibitor 19 is not limited to the plate 19*a* but may be a cornered member or the like as long as it can inhibit or block the rotation of oil in the oil cup 17.

Figure 2:
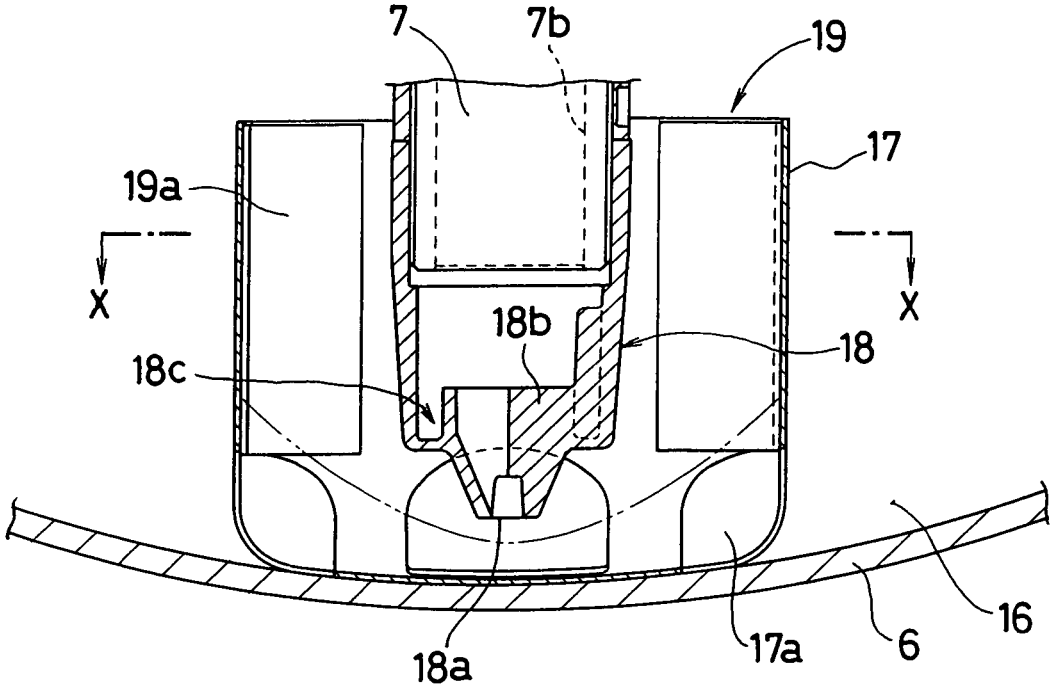
FIG. 2 is a partial enlarged view showing a rotation inhibitor in the embodiment of the present invention.

The oil pump 18 is attached to the lower end of the driveshaft 7. The oil pump 18 has a suction port 18*a* formed through the lower end as shown in FIG. 2. In the vicinity of the suction port 18*a*, a paddle 18*b* is provided. In addition, an annular recess is formed along the inner wall or plural recesses are formed at intervals to form a foreign matter separation mechanism 18*c*. Thus, the oil pump 18 can suck up the oil from inside the oil cup 17 in response to the rotation of the driveshaft 7.

The oil sucked up through the oil pump 18 is moved by the centrifugal force upward along the inner wall of the oil passage 7*b* formed inside the driveshaft 7 along the axis. It is then supplied from a plurality of oil supply holes 7*c* provided at midpoints in the oil passage 7 to the sliding portion of the compressive element 3 and the bearing portions 8*a*, 14*a* of the driveshaft 7.

The oil passage 7*b* in the driveshaft 7 has an upper end brought into communication with an oil passage 7*d* formed inside the eccentric cum 7*a* along the axis as shown in FIG. 1. This oil passage 7*d* is in communication with a plurality of oil supply holes 3*e* formed inside the swinging scroll 3*b*. The oil moved upward from the oil passage 7*d* of the eccentric cum 7*a* is supplied to the bearing 10 portion that bears the eccentric cum 7*a*. The oil led into the oil supply hole 3*e* of the swinging scroll 3*b* moves from the upper end of the oil supply hole 3*e* along the outer circumference of the swinging scroll 3*b* down to the lower surface. It is then supplied to the sliding surface between the swinging scroll 3*b* and the upper support frame 8. When the driveshaft 7 stops rotations, the oil inside the oil passages 7*b*, 7*d* moves downward along the inner wall, drops from the lower end of the oil pump 18 down into the oil cup 17 and returns to the oil storage 16.

The oil supplied to the sliding portion of the swinging scroll 3*b* and the bearing portions of the driveshaft 7 and the eccentric cum 7*a* partly drops and returns to the oil storage 16. This return oil may contain fine foreign matters such as metal powders caused by friction at the sliding portion and the bearing portion. The return oil containing such fine foreign matters is mixed with the return oil from the driveshaft 7 in the oil cup 17 or the oil storage 16 and used repeatedly. Therefore, the amount of the foreign matter mixed in the oil sucked up from the oil pump 18 gradually increases. In this embodiment, the foreign matter separation mechanism 18*c* is provided along the inner wall of the oil pump 18 as described above. Therefore, when the oil returns, the oil released from the oil passage 7*b* of the driveshaft 7 moves downward along the inner wall of the oil pump 8 and flows into the foreign matter separation mechanism 18*c*. The return oil flowing into the foreign matter separation mechanism 18*c* is subjected to separation of oil from the foreign matter based on a difference in specific gravity. In this case, the foreign matter precipitates on the bottom of the foreign matter separation mechanism 18*c* while the oil overflows the foreign matter separation mechanism 18*c*, drops from the lower end of the oil pump 18 down to the oil cup 17 and returns to the oil storage 16. Thus, the foreign matter can be separated from inside the return oil. In the present invention, the presence of the foreign matter separation mechanism 18*c* enlarges the oil pump 18 and results in increased rotational friction that tends to easily rotate oil. In this case, however, the plate 19*a* is provided in the oil cup 17 to prevent the oil from rotating as described above.

A terminal 20 is attached to the upper portion of the sidewall of the container body 1. The terminal has an inner terminal connected to the stator 2*a* of the electric element 2 via an inner lead (not shown), and an outer terminal connected to a lead from an external power source (not shown). Thus, when power is supplied from the external power source, the electric element 2 can be operated through the terminal 20.

A suction pipe 21 is attached to a required location on the sidewall of the container body 1. The suction pipe 21 has an inner end connected to a suction port (not shown) of the compressive element 3 via a coupling pipe. The suction pipe 21 has an outer end connected to piping from a gas supply source (not shown). Thus, when a refrigerant gas is supplied from the suction pipe 21, the refrigerant gas is sucked from the suction port of the compressive element 3 into the compression chamber, and compressed by turns of the swinging scroll 3*b*. The compressed refrigerant gas is discharged from the discharge port 3*c* of the fixed scroll 3*a* and discharged from the discharge pipe 12 to external.

The scroll compressor according to the embodiment is configured as above and, when power is supplied from the external power source, the electric element 2 operates to rotate the rotor 2*b*. In response to the rotation of the rotor 2*b*, the driveshaft 7 rotates about the axis to turn the swinging scroll 3*b* of the compressive element 3 via the eccentric cum 7*a*. As a result, a gas such as a refrigerant gas supplied from the suction pipe 21 is sucked from the suction port into the compression chamber to start running of compression.

During running of compression, the driveshaft 7 rotates about the axis together with the oil pump 18 to suck up the oil from the oil cup 17 through the suction port 18*a* and send it to the oil passage 7*b* of the driveshaft 7. As the oil pump 18 rotates, rotational friction thereof forces the oil in the oil cup 17 to rotate in the same direction as the direction of the rotation of the oil pump. Therefore, in the oil cup 17, the oil surface exhibits almost parabolic in cross-section, falls lower at the central portion and gradually rises higher toward the outer circumference in a curved shape.

The oil surface in the oil storage 16 usually exceeds the upper edge of the oil cup 17 and locates in the vicinity of the lower surface of the lower support frame 14. In such the state, the rotation of oil in the oil cup 17 causes no harm in sucking up oil by the oil pump 18. When the amount of oil in the oil storage 16 reduces, the height of the oil surface may lower below the upper edge of the oil cup 17. Even in such the case, if the central portion of the oil surface almost parabolic in cross-section locates at a higher position than the suction port 18*a* of the oil pump 18, the oil can be sucked up. The amount of oil in the oil storage 16 may reduce further. When the central portion of the oil surface almost parabolic in cross-section in the oil cup 17 locates at a lower position than the suction port 18*a* of the oil pump 18 as shown with the phantom line in FIG. 2, the oil can not be sucked up any more.

In the present invention, the rotation inhibitor 19 is provided including plural plates 19*a* along the inner wall of the oil cup 17 as described above. Accordingly, it is possible to inhibit the rotation of oil in the oil cup 17. The inhibition of the rotation of oil can also prevent the oil surface from waving. Thus, the rotational force of oil in the oil cup 17 can be remarkably reduced and the central portion of the oil surface can be retained at a higher position. Therefore, it is possible to suck up the oil surely.

Preferably, the plates 19*a* of the rotation inhibitor 19 are attached such that the lower end locates near or impinges the bottom of the oil cup 17 and the side ends locate as near the outer wall of the oil pump 18 as possible. In addition, the plates are attached as many as possible to improve the effect of inhibiting the rotation of oil.

The oil sucked up by the oil (pump 18 flows in the oil passage 7*b* in the driveshaft 7 and moves upward along the inner wall as described above. During the movement, the oil is supplied from the oil supply hole 7*c* corresponding to the bearing portion 14*a* of the lower support frame 14 to that bearing portion 14*a*. It is then supplied from the oil supply hole 7*c* corresponding to the bearing portion 18*a* of the upper support frame 18 to that bearing portion 18*a*. Further the oil moves upward continuously and flows in the oil passage 7*d* in the eccentric cum 7*a*. Then it exits from the upper end of the oil passage 7*d* and is supplied to the bearing 10 portion that bears the eccentric cum 7*a*. In addition, it passes through the oil supply hole 3*e* of the swinging scroll 3*b* and falls along the outer circumference of the swinging scroll 3*b* down to the lower surface, and is supplied to the sliding surface between the swinging scroll 3*b* and the upper support frame 8. When the driveshaft 7 stops rotations, the oil inside the oil passages 7*b*, 7*d* moves downward along the inner wall, drops from the lower end of the oil pump 18 down into the oil cup 17 and returns to the oil storage 16.

The refrigerant gas sucked from the suction port of the compressive element 3 into the compression chamber is compressed by turns of the swinging scroll 3*b* as described earlier. Thereafter, the compressed gas flows from the discharge port 3*c* of the fixed scroll 3*a* through the recess 3*d* and the through hole 4*a* of the partition disc 4 into the upper spatial region. In addition, it is discharged from the discharge pipe 12 to external and sent in a freezing cycle via piping (not shown) connected to the discharge pipe 12. After circulating in the freezing cycle, the refrigerant gas is fed back from the suction pipe 21 via piping (not shown) to the container body 1, and sucked from the suction port of the compressive element 3 into the compression chamber via the coupling pipe.

The above embodiment has been described as an example applied to the scroll compressor though the present invention is not limited to the scroll compressor but rather applicable to compressors of other types if they are equipped with the oil cup in the oil storage.

The present invention is effectively available in compressors equipped with the oil cup in the oil storage. The oil cup is provided with the rotation inhibitor to inhibit oil to rotate in response to the rotation of the oil pump. In particular, even if the amount of oil in the oil pump reduces, the oil pump can suck up the oil surely. Thus, sufficient lubrication of the sliding portion of the compressive element and the bearing portion of the driveshaft can improve the reliability of the compressor.

What is claimed is:

1. A compressor, comprising:

a container;

an electric element provided in the container;

a compressive element driven by the electric element;

an oil storage provided in the bottom of the container;

an oil cup fixed in the bottom of the container in communication with the oil storage through a through-hole formed at the circumference beneath a sidewall of the oil cup;

a driveshaft axially installed on the rotor of the electric element;

an oil pump attached to the lower end of the driveshaft, the oil pump having a suction port located on the central axis of the oil cup and in the vicinity of the bottom of the oil cup; and a rotation inhibitor provided on an inner wall of the oil cup to inhibit rotation of the oil in the oil cup caused by friction with the oil pump to prevent a surface of the oil from being lowered at the suction port of the oil pump.

2. The compressor according to claim 1, wherein the rotation inhibitor includes a plate having one end fixed to the inner wall of the oil cup and the other end disposed almost vertically toward the central axis of the oil cup.

3. The compressor according to claim 2, wherein the plate is rectangular and attached as locating an upper end in the vicinity of the upper edge of the oil cup, a lower end in the vicinity of the bottom of the oil cup, and side ends in the vicinity of the outer wall of the oil pump.

4. The compressor according to claim 3, wherein the plate is one of a plurality of such plates attached at an equal interval along the inner wall of the oil cup.

5. The compressor according to claim 2, wherein the plate is one of a plurality of such plates attached at an equal interval along the inner wall of the oil cup.

* * * * *